US005352466A

United States Patent [19]

Delonis

[11] Patent Number: 5,352,466

[45] Date of Patent: Oct. 4, 1994

[54] TABBED EASY-OPEN BRICK COFFEE PACKAGE

[75] Inventor: Michael E. Delonis, Croton-on-Hudson, N.Y.

[73] Assignee: Kraft General Foods, Inc., Northfield, Ill.

[21] Appl. No.: 776,968

[22] Filed: Oct. 15, 1991

[51] Int. Cl.[5] ..... B54D 77/10; B54D 81/20

[52] U.S. Cl. ..... 426/123; 426/126; 426/410; 426/413; 383/35; 383/210

[58] Field of Search ..... 426/410, 123, 126, 413; 383/35, 210

[56] References Cited

U.S. PATENT DOCUMENTS

| | | | |
|---|---|---|---|
| 2,528,778 | 11/1950 | Piazze | 383/210 |
| 2,998,880 | 9/1961 | Ladd | 383/35 |
| 3,123,210 | 3/1964 | Hermanson et al. | 383/210 |
| 3,256,981 | 6/1966 | Kurtz | 383/210 |
| 3,278,109 | 10/1966 | Salway | 383/210 |
| 3,332,549 | 7/1967 | Powell | 383/210 |
| 3,342,326 | 9/1967 | Zackheim | 383/210 |
| 3,419,137 | 12/1968 | Walck | 383/210 |
| 3,439,868 | 4/1969 | Kuhnle | 383/210 |
| 3,647,485 | 3/1972 | Seiferth et al. | 426/123 |
| 3,926,311 | 12/1975 | Laske | 383/210 |
| 4,176,746 | 12/1979 | Kool | 383/210 |
| 4,488,647 | 12/1984 | Davis | 383/210 |
| 4,603,537 | 8/1986 | Pace | 383/210 |
| 4,667,453 | 5/1987 | Goglio | 426/123 |
| 4,705,174 | 11/1987 | Goglio | 383/210 |
| 4,787,517 | 11/1988 | Martin | 383/35 |
| 4,865,854 | 9/1989 | Larson | 426/123 |
| 4,889,731 | 12/1989 | Williams | 426/123 |
| 4,944,409 | 7/1990 | Busche et al. | 383/210 |

*Primary Examiner*—Steven Weinstein

*Attorney, Agent, or Firm*—Thomas A. Marcoux; Thomas R. Savoie

[57] ABSTRACT

An easy open tabbed package made of a flexible laminate material comprises a product enclosure having side walls, a bottom portion and an overlapping top portion. The overlapping top portion includes opposing flaps having a sealable region wherein a hand-peelable heat seal can be applied and a raised grippable tab means integral with the sealable region of each flap. The package is designed to enclose a product such as roast and ground coffee which can be vacuum-packed and peelably sealed inside the flexible laminate enclosure. The tab means, which preferably comprises a wave-shaped raised tab, is constructed integrally with the peel-seal region and greatly facilitates opening of the package by pulling outwardly from the center.

9 Claims, 2 Drawing Sheets

FIG. 1
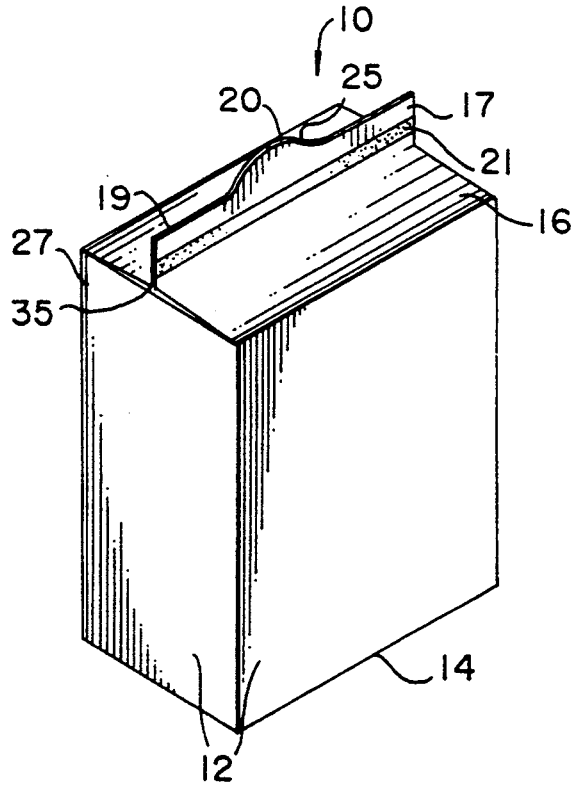
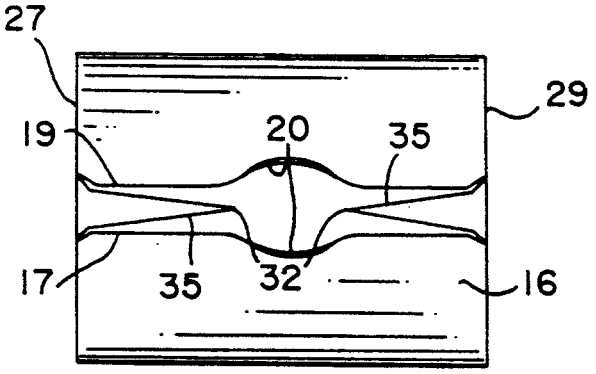
FIG.2
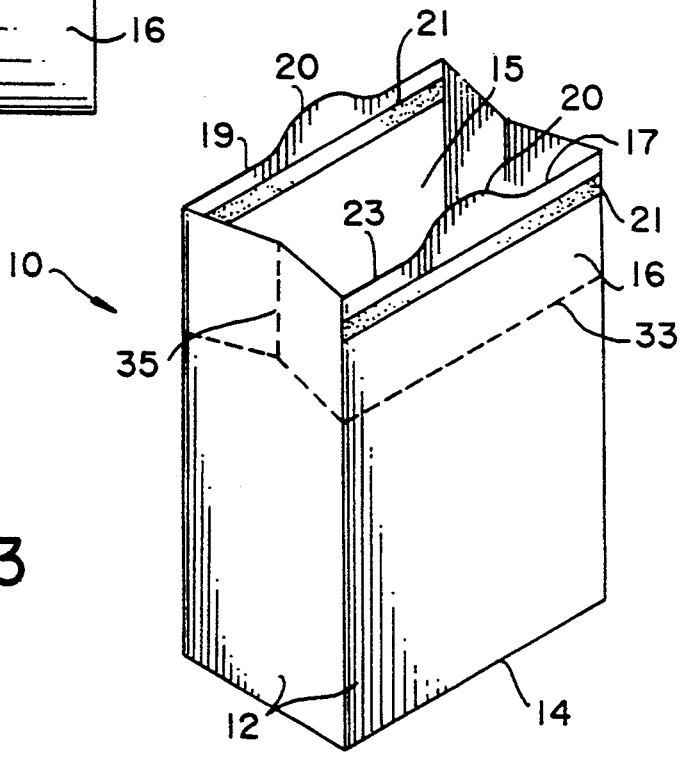
FIG.3

TABBED EASY-OPEN BRICK COFFEE PACKAGE

FIELD OF THE INVENTION

The invention relates in general to an improvement in flexible packages of the type having an easy opening peelable seal.

BACKGROUND OF THE INVENTION

Many products are now packaged in a variety of flexible laminate materials which provide suitable protection against contamination by moisture, oxygen or other gases and which feature a hand-peelable heat seal for consumer convenience. In particular, many coffee products, such as coffee beans and roast and ground coffee, are now being marketed in various flexible laminate packages which can retain freshness and maintain quality for long periods of time. In most conventional coffee packages, a flexible laminate is formed into a bag-like enclosure, filled with the coffee product, and sealed with a peelable seal at atmospheric pressures. Certain packages are also equipped with release valve means for venting gases generated by the coffee product after sealing. Very often, there is very minimal room provided for grasping the package where it will be opened. As a result, gripping and opening of these packages is often extremely difficult and frustrating.

Still other coffee packages are known which are designed to be vacuum sealed and which are constructed using suitably strong laminate materials that can be peelably sealed yet still hold a vacuum. One highly desirable form of packaging that is presently in use is the so-called "brick package" wherein the coffee or other dry granular food product is vacuum packed in the form and consistency of a brick. This form of packaging is particularly advantageous because it retains freshness for extended periods of time, and the package itself is desirable because it takes up little room and is stackable. Again, however, "brick" packaging suffers from the drawback that even though the closing force used is such to provide a seal capable of retaining a vacuum, there is very little room provided by which the package can be grasped sufficiently so that the vacuum seal can be broken. As a result, current brick packages are also extremely difficult to open.

Although there are many examples of packages that have supposedly peelable seals, these packages generally have structures which make opening of the package somewhat difficult or inconvenient. This is particularly the case with regard to those packages that are also designed to retain a vacuum seal. Examples of such packages are disclosed in U.S. Pat. Nos. 4,944,409 (Busche et al) and 4,488,647 (Davis). In the Busche patent, a peelably sealed package is disclosed in which inner sealing layers of thermoplastic materials on opposing package walls are heat sealed to form a strong bond. Similarly in the Davis patent, a flexible laminate package is disclosed which comprises a bag-like body member having a hand-peelable seal comprised of a heat-fusible plastic polymeric coating. Although these packages are suitable for holding a vacuum such as would be required in a brick coffee package, they do not disclose a seal structure which facilitates grasping and opening of such packages in a simple and convenient manner. As a result, these packages are somewhat difficult to open, thereby reducing their desirability to consumers.

It is thus highly desirable to develop a package made of flexible laminate materials which has a sufficiently strong seal to retain freshness for extended periods of time, and yet which is "consumer friendly" in that it has a readily-grippable seal region so that the package can be easily opened by the consumer.

SUMMARY OF THE INVENTION

In accordance with the present invention, an easy open package suitable for packaging coffee or other dry granular food products is provided which comprises a flexible laminate material shaped to enclose a product, a polymeric peelable heat seal portion spaced from the top end of the enclosure, and raised grippable tab means integral with the seal portion which allows the consumer to easily open the package by pulling apart the tabs. The grippable tab is formed integrally with the seal portion so as to have the necessary strength to be peeled open without tearing the package.

In the preferred embodiment of the invention, the package is suitable for use as a brick package for coffee beans, roast and ground coffee, and other dry granular beverage products. In this embodiment, the flexible laminate material used to construct the package is capable of retaining a vacuum, and the packaging is tightly wrapped around the food product and vacuum sealed. The grippable raised tab formed in accordance with the invention is particularly advantageous in this embodiment because it allows for much greater ease of opening than prior brick packages, and it will increase the desirability and marketability of this type of package.

It is thus an object of the present invention to provide a package having increased suitability for packaging dry granular food products which will overcome previous problems with regard to the opening of such packages.

It is also an object of the present invention to provide a flexible laminate package with a seal characterized by a peelable heat seal portion having a raised grippable tab means formed integrally therewith in order to facilitate the gripping of the package at the peelable seal area and the opening of the package by the consumer.

It is still another object of the present invention to provide food package which is suitable for use in brick packaging of dry granular foods and which has sufficient seal strength so as to retain a vacuum.

It is still further an object of the present invention to provide a food package formed of flexible packaging material which allows for increased consumer convenience and satisfaction, and which can be used in conjunction with a variety of vacuum-packed products.

These and other objects of the present invention are provided by the tabbed easy open package of the present invention described in detail with regard to the preferred embodiments below.

BRIEF DESCRIPTION OF THE DRAWINGS

Preferred embodiments of the present invention are described below with respect to the figures, wherein:

FIG. 1 is a perspective view of one embodiment of a package in accordance with the present invention.

FIG. 2 is a top plan view of the package of FIG. 1 illustrating the gusset structure of the package in slightly exaggerated form for the purpose of clarity.

FIG. 3 is a perspective view of the package FIG. 1 before sealing.

DETAILED DESCRIPTION OF THE PREFERRED EMBODIMENTS

Figure 4:
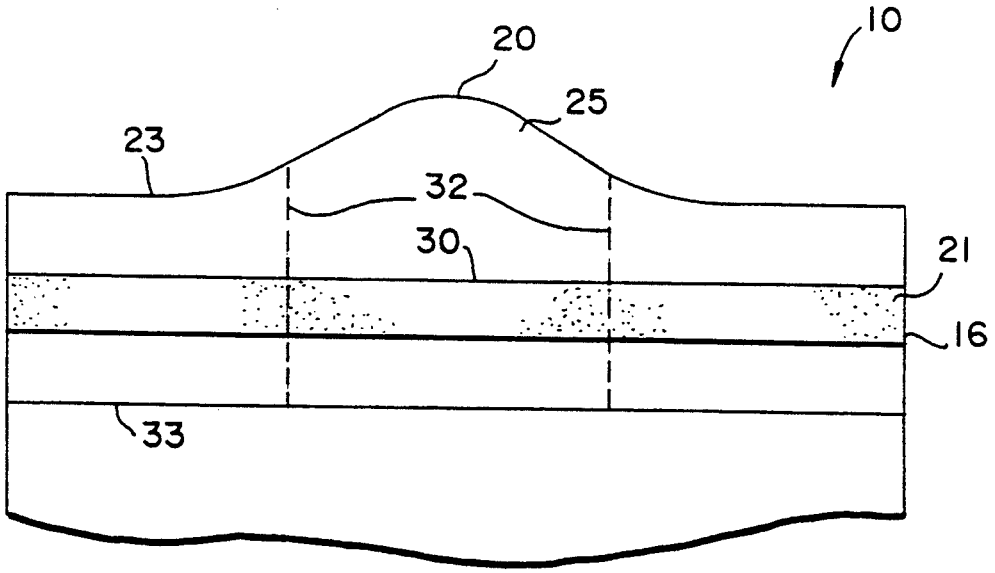
FIG. 4 is an enlarged partial front view of the tabbed region of the package of the present invention.

The package 10 in accordance with the present invention as described below is depicted in FIGS. 1–5 with like numerals indicating like elements in the different views.

In the preferred embodiment, the package 10, as best shown in FIG. 1, is comprised of a flexible laminate package material shaped so as to define a product enclosure constructed with side walls 12, end walls 13, a generally rectangular bottom portion 14 having long sides and short sides, and overlapping top portion 16. The overlapping top portion 16 includes upper portions 16*a* of side walls 12 and upper portions 16*b* of end walls 13. The upper portions 16*a* form flaps 17 and 19 and the upper portion 16*b* form infolded gussets 35. A hand peelable seal 21 extends all around the interior of these upper portions. The closure structure is formed as flaps 17 and 19 are closed onto infolded gussets 35, leaving a central part between the innermost ends 32 of the gussets 35 where the side walls are sealed to each other and other parts outward of 32 where the side walls are sealed to the facing walls of the gussets 35. In the center of flaps 17 and 19, a central grippable raised tab means 20 is provided which is designed to be positioned above and integral with heat seal region 21, and which will facilitate opening of the package 10. The tab 20 is preferably constructed integrally with the seal region to provide sufficient grip strength so that the package can be opened quickly and conveniently by the consumer. Additionally, as best observed in FIG. 2, the grippable raised tab 20 is preferably constructed so that a substantial part of tab 20 will not overlap with the gusset area 35. Constructing the package in this manner further ensures that only the proper force needed to open the package will be applied to the tab and thus improper tearing of the tab during opening will be avoided.

In practice, the actual size and shape of package 10 can vary greatly and will be dependent in large part upon the size and type of product that will be packaged therein. As best observed in FIG. 3, the package 10 can be formed into the shape of a bag-like enclosure having side walls 12, end walls 13, bottom portion 14 and top portion 16 containing the sealable region 21 and the raised grippable tab 20. This upright bag-like product enclosure can be filled, folded and sealed using conventional means well known in the art. In one embodiment of the invention, the package filled with the desired dry granular product will remain in the form of a bag-like enclosure. In the preferred embodiment, however, such as shown in FIG. 1, the packaging material is drawn tightly around the food product which is formed into the shape of a brick, and the package 10 is vacuum sealed. This tabbed brick package can then be stacked, packed in cartons and eventually marketed to consumers in this form.

In the preferred embodiment of the present invention, the tab is constructed in the form of wave 25 as best seen in FIG. 4. It has been determined that this wave-shaped tab is advantageous in that it can resist the tendency to open up during the sealing of the package, yet still be grasped sufficiently to enable easy opening of the package. To accomplish these results, it is preferable that the wave-shaped tab be centrally located on the flap, so that a substantial part of the tab 20 does not overlap with gussets 35.

Figure 5:
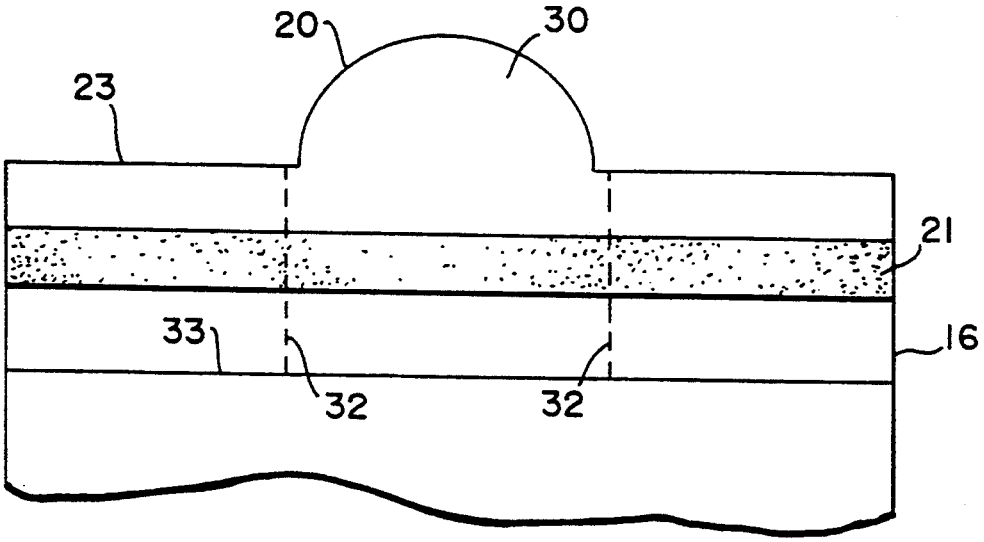
FIG. 5 is an enlarged partial front view of the tabbed portion of an alternate embodiment of the package of the present invention.

The grippable tabbed region 20 of the flaps 17 and 19 of the present invention is formed into any suitable size and shape so that it can be sturdily gripped to allow opening of the package 10. Thus, although the wave-shaped tab 25 is preferred, other tabs of different sizes and shapes will also be suitable for use in the present invention. For example, a package having a semi-circular tab 30, as depicted in FIG. 5, will also be considered within the scope of the invention. Still other types and shapes for the tabbed region 20 will be suitable in the package of the invention as will be readily apparent to one skilled in the art.

The package 10 of the present invention can be made from any flexible laminate material well known in the art which can be formed into a package suitable for containing dry granular food products. It is preferred that package be one that is formed with a hand-peelable heat seal that is capable of retaining a vacuum. A number of materials and configurations are possible for the package of the invention, such as the package and peelable seal embodiments as described in U.S. Pat. Nos. 4,944,409 (Busche et al.) and 4,488,647 (Davis), incorporated herein by reference.

In the preferred embodiment, the package 10 of the present invention can be constructed with a peelable heat seal such as that disclosed in U.S. Pat. No. 4,944,409 (Busche et al.). In this embodiment, the package will include a first and second package wall joined about three edges so as to form a bag-like product enclosure with an open top, such as shown in FIG. 3. The first of these walls preferably comprises a thermoplastic polymeric film of three layers, with a middle layer disposed between an inner sealant layer and an outer layer. The middle layer is peelably bonded to either the inner or outer layer, and permanently bonded to the other. The second package wall comprises an outer layer and an inner sealant layer. It is preferred that the outer layers of both walls be comprised of either ethylene vinyl acetate copolymer, linear low density polyethylene, low density polyethylene, neutralized ethylene acid copolymer or other suitable extrudable polyolefin polymers or copolymers. The inner sealant layers are designed so that when sealing is desired, these two layers are brought adjacent each other and bonded by heat using conventional sealing machinery. The inner layers as composed of any suitable materials which are known to seal well to themselves, such as the materials used to construct the outer layers discussed above. Generally, the outer layers have a thickness between about 0.5 and 4.0 mils, and the inner layers are roughly about 0.1 to 0.5 mils in thickness.

The middle layer of the first package wall of this preferred embodiment is selected to have a relatively low peel strength when peelably bonded to either the first outer layer or inner sealant layer of the first wall. The middle layer is preferably constructed of a combination of polybutylene and either ethylene vinyl acetate copolymer, linear low density polyethylene, neutralized ethylene acid copolymer or unneutralized ethylene acid copolymer, and has a thickness of about 0.1 to 0.5 mils. In this preferred embodiment, peel failure is designed to occur between the first inner sealant layer and the middle layer where the bond is the weakest, and the force required to achieve peel failure is roughly between 600 and 1800 grams per inch width.

The package 10 of the present invention can also be formed from a flexible laminate material such as that disclosed in U.S. Pat. No. 4,488,647 (Davis). In this embodiment, the laminate material has a ply capable of carrying printing, a barrier ply to which the exterior ply is laminated, and a sealing ply which forms the inner surface of the package enclosure. A hand-peelable seal is provided on top portion 16 of the package 10 by means of a heat-fusible plastic polymeric coating 21. The seal is arranged to provide sufficient strength to retain a vacuum within the package while being shipped and handled, yet is also capable of being opened by hand using the tabbed gripping region to pull apart the package flaps.

The seal for the package described above may be comprised of ethylene vinyl acetate, with an optional added amount of magnesium silicate. In one such embodiment, the material that seals the laminate package of the invention is comprised of about 80 to 90% ethylene-vinyl acetate and about 10 to 20% magnesium silicate. The heat seal applied at seal region 21 is bonded after the package is filled with product using any conventional sealing machine known in the art such as a heat seal bar capable of applying heat and pressure to the seal region. It is preferred that the heat seal is formed with a suitable seal strength so that it can retain a vacuum, yet still be peeled open easily by the consumer using the grippable tabbed region. In general, seal strengths of from about 600 to 1800 grams per inch width are preferred for the heat seal of this embodiment of the invention.

In another embodiment, the package 10 of the invention may also be constructed from a flexible laminate material comprising a four-ply structure having an outer clear polyester layer, an aluminum foil layer next to the polyester, a nylon intermediate layer and an inner layer of polyethylene. In manufacturing this laminate, the polyester, aluminum foil, nylon and polyethylene layers can be formed into a single web structure, and printing may be applied to the polyester layer using conventional multi-color gravure or other suitable methods. Additionally, a web structure having an outer foil layer with the name of the product or other suitable information printed thereon can be formed, and a clear polyester layer can be applied over the foil to finish the laminate.

As discussed above, the package 10 of the present invention is preferably constructed by first fashioning the flexible laminate material formed into a bag-like product enclosure by any of the various conventional methods known. The package thus is first formed in the shape of a typical "stand-up" square bottomed bag, comprising bottom 14, side walls 12, and the sealable top portion 16, all which define product enclosure 15, as observed in FIG. 3. The bag-like enclosure can then be used to form a brick-type package around the desired product in any conventional manner known in the art. Although in the preferred embodiment the package is designed to contain a coffee product, such as whole coffee beans, roast and ground coffee or other coffee product in dry form, the package 10 can be used to contain any other dry granular food product that is desired to be packed in sealable vacuum packages, such as cocoa, tea, non-fat milk powder and powdered beverage mixes.

As will be clear to one skilled in the art, the package 10, made of a flexible laminate material as described above, is formed by means of conventional folding, gusseting and heat sealing techniques. In the preferred embodiment, the opposing flaps 17 and 19 and the gussets 35 are brought together to form a heat seal at region 21. This is best observed by the top plan view of FIG. 2 in which the folded gussets 35 are disposed inwardly from the sides end wall upper portions **16*b* so as to be positioned between the flaps 17 and 19 when those flaps are brought together. The gussets preferably extend inwardly toward the center, but the ends 32 do not meet. As will be obvious to one skilled in the art, the bag will be retained in the open configuration such as observed in FIG. 3 while the package is filled by conventional means, and the folding and sealing of the package is carried out after the product has reached the desired level. In the particularly preferred embodiment, the package 10** can be sealed using vacuum sealing means well known in the art.

It will be well understood by one skilled in the art that the dimensions of the package 10 of the invention are variable, and will depend on the size and dimensions of the product to be packaged. In the preferred embodiment of the tabbed region shown in front view in FIG. 4, the maximum height from the upper end 30 of the sealable region 21 to the end of tab 20 is about 14 mm. In this embodiment, the sealable top portion 16 is roughly about 30 mm at its maximum height, the sealable region 21 is about 6 mm in thickness, and the recess between the generally horizontal upper edge 23 and the upper end 30 of the sealable region 21 is about 6 mm at its shortest width. It is feasible to extend the grippable tab region above the sealable region 21 to approximately 16 mm. The grippable tab region should be at least about 12 mm at its maximum width (from top to sealing region) to obtain a good easy-to-open package.

The tabbed easy open package of the present invention can be used for a wide variety of products, and provides a distinct advantage in terms of grippability and ease of opening. Although the package 10 of the present invention has been described in terms of the specific embodiments above, it will be clear to one skilled in the art that many alternative embodiments and materials not specifically described herein are possible which fall within the scope of the invention.

What is claimed is:

1. A package formed of a flexible material which encloses a food product under vacuum conditions, said package being in the shape of a brick, comprising a regular rectangular shaped bottom having opposed long sides and opposed short sides, a pair of opposed side walls extending up from the long sides of the rectangular shaped bottom, and a pair of opposed end walls extending up from the short sides of the rectangular shaped bottom, said product being contained in the package, the side walls and end walls extending above the product to form an upper closure structure, said upper closure structure formed by upper portions of said end walls above the product being folded in to form two opposing gussets and lie along the top centerline of the package that extends parallel to the side walls and midway therebetween, and upper portions of the side walls above the produce being positioned substantially along said centerline of the package, the upper portions of the side walls forming the top of the package above the product, each gusset extending inwardly from its end wall toward the vertical center of the package, the innermost ends of the two opposing gussets being spaced from each other leaving a central opening between the two innermost ends of the two gussets, the upper closure structure comprising a peelable heat seal extending across the full length of said centerline which is strong enough to maintain said vacuum conditions within the package, wherein said peelable heat seal comprises both the upper portions of the folded in gussets peelably sealed to the upper portions of the side walls which they engage, as well as the upper portions of the side walls peelably sealed to each other in the central portion thereof between the innermost ends of the gussets, the uppermost portions of said side walls and end walls comprising upper edges which form a generally horizontal upper edge of the package, said uppermost portions of said side and end walls between said peelable seal and said upper edges being unsealed to any wall and defining an unsealed flap in each upper portion of said side wall, and including a grippable tab integral with each side wall and extending up from the upper edge of each of said flaps, each tab being in the form of a wave, the top of the wave being at least 12 mm above the seal at the center of each side wall, and the edges of the tab extending downwardly from said top thereof along a curved path, meeting the side wall edge of its respective side wall outwardly of the innermost ends of the gussets, such that the major part of each tab is in the central part of the package between the innermost ends of the gussets where the two side walls are peelably sealed to each other, with a minor portion of each tab being located outwardly of the innermost ends of the gussets such that the tabs are easily gripped and positioned to facilitate opening of the package by pulling the tabs apart to pull the seal initially in the central part of the package, peeling the two side walls away from each other, and subsequently peeling the side walls from their engagement with the gusseted end walls.

2. A package according to claim 1, wherein the tab intersects its respective upper side wall edge along a curved path.

3. A package according to claim 1, wherein the height of the tab above the seal is approximately 14 mm.

4. A package according to claim 1, wherein the height of the tab above the seal is approximately 16 mm.

5. A package according to claim 1, wherein the food product is selected from the group consisting of roasted coffee beans, roast and ground coffee, cocoa, tea and powdered milk.

6. A package according to claim 1, wherein said peelable seal has a seal strength of roughly about 600 to 1800 grams per inch width.

7. A package according to claim 1, wherein said flexible material is a laminate which comprises an outer polyester layer, an aluminum foil layer, a nylon intermediate layer and an inner polyethylene layer.

8. A package according to claim 7, wherein each tab intersects its respective upper side wall edge along a curved path and the height of the tab above the seal is approximately 16 mm.

9. A package according to claim 8, wherein the product is roasted coffee beans or roast and ground coffee.

* * * * *